United States Patent [19]

McCaslin

[11] 4,086,724

[45] May 2, 1978

[54] MOTORIZED TOY VEHICLE HAVING IMPROVED CONTROL MEANS

[76] Inventor: Robert E. McCaslin, 81 Anchor Dr., Pittsburg, Calif. 94565

[21] Appl. No.: 648,831

[22] Filed: Jan. 16, 1976

[51] Int. Cl.[2] ..... A63H 29/22

[52] U.S. Cl. ..... 46/256; 46/262

[58] Field of Search ..... 46/210, 256, 262

[56] References Cited

U.S. PATENT DOCUMENTS

| | | | |
|---|---|---|---|
| 2,974,441 | 3/1961 | Denner | 46/256 |
| 3,142,132 | 7/1964 | Johnson | 46/256 |
| 3,171,963 | 3/1965 | Bourguignon | 46/254 |
| 3,280,501 | 10/1966 | Hornbostel | 46/254 |
| 3,406,481 | 10/1968 | Tachi | 46/256 |
| 3,458,950 | 8/1969 | Tomaro | 46/256 |
| 3,782,031 | 1/1974 | Byron | 46/254 |
| 3,961,441 | 6/1976 | Sato | 46/256 |

*Primary Examiner*—Louis G. Mancene

*Assistant Examiner*—Robert F. Cutting

[57] ABSTRACT

A toy vehicle operated by a motor and having improved control means permitting numerous changes in movement of the toy vehicle along a medium, such as a surface when the toy vehicle has wheels. As to a wheeled vehicle defining one embodiment disclosed herein, the control operates to permit the toy vehicle to change direction, to continue to move forwardly or to stop in response to an external command, such as the sound of the human voice, a light from a light source or other type of signal. The vehicle has steering wheel means coupled to a drive means which is rotatably through a 360° arc in response to a command. The amount of rotation is determined by the duration of the command. Thus, a large number of changes can be made within the 360° arc capability of the drive means. Several embodiments of the control means are disclosed.

22 Claims, 11 Drawing Figures

MOTORIZED TOY VEHICLE HAVING IMPROVED CONTROL MEANS

This invention relates to improvements in toy vehicles of the type driven by small motors and, more particularly. to a motor driven toy vehicle whose movements can be selectively changed by voice and other commands.

BACKGROUND OF THE INVENTION

Voice-actuated, motorized toy vehicles have been considered in the past and have been disclosed in certain publications, including the following U.S. Pat. Nos. 2,974,441; 2,995,866; 3,103,762; 3,142,132; and 3,458,950. For the most part, the toys of these disclosures are made so that the user has only minimum control over the toy itself. For instance, U.S. Pat. No. 2,974,441 discloses a toy vehicle which has a steering device movable only into three operative positions, namely, forward left and right. It cannot move into operative positions intermediate the three. The other patents disclose structure which have similar drawbacks. None shows a toy vehicle having steering means which can be moved into any one of a great number of number of different operative positions. For this reason, the toy vehicles of the prior art are not able to perform all commands which could be given to them; thus, the entertainment value of conventional toy vehicles has, until now, been limited.

SUMMARY OF THE INVENTION

The present invention meets the aforesaid need by providing a toy vehicle having an improved control means operable to cause the vehicle to respond immediately and precisely to a voice command or other signal sent from a remote location to a sensor carried on the vehicle and forming part of the control means. The end result of the use of the vehicle is greater entertainment and enjoyment for the user and others than is capable of being provided by conventional motorized toy vehicles. Moreover, the toy vehicle and its improved control means, when in use, mystifies those persons viewing it for the first time as to the relationship between the toy vehicle itself and the person giving the commands to it. This relationship is achieved by constructing the control means to cause the movements of the toy vehicle to change by greater or lesser amounts in accordance with the duration of the command and such duration can be selectively controlled.

The control means of the toy vehicle of the present invention is constructed to provide a random operation for toy vehicle itself. Such random operation is achieved because of the user can randomly select, by a command, any one of a great number of operating states or directions of movement which he desires the toy vehicle to perform or to follow. This assures that the vehicle will respond to any command provided that the user has learned to give the proper command and if the duration of the command is in accordance with the condition of movement of the vehicle at the time the command is given.

The foregoing random operation is achieved by providing a steering or directional control member and a drive means therefor, the drive means being rotatable through a 360° arc and through fractions of such arc depending upon the duration of the command given to the drive means. Thus, the many different states and directions of movement of the vehicle can be controlled, i.e. whether it is moving or stopped, moving right or left or straight forwardly or moving in any direction intermediate the right, left and forward directions. By virtue of such random operation, the toy vehicle can, upon receiving the proper command, move precisely as the voice command indicates and this serves to enhance the enjoyment of the use of the vehicle as well as for entertaining others and adding mystery to the operation of the vehicle.

The control means of the toy vehicle has a sensor which can be a microphone for sensing voice signals which, when amplified, are used to operate the drive means for the steering member. In the case of a wheeled toy vehicle, the latter can use the same motor to rotate the drive wheels and the steering member, or the drive wheels can be rotated by a drive means.

Another embodiment of the control means of the toy vehicle has a multivibrator whose output pulses can be used to actuate the drive means for the steering member and whose input is the output of the microphone. Instead of a microphone, a photocell can serve as the command sensor for sensing a command in the form of a light beam from a light source so that the vehicle is made to move toward the light so long as the light is on. Other improvements include stopping the vehicle drive wheels when the control member is in a predetermined position.

The primary object of this invention is to provide a motorized toy vehicle having an improved control means to provide random operation of the toy vehicle in response to external commands whereby the use of the toy vehicle will provide enjoyment and entertainment for long periods of time as well as to permit operation and control of the toy vehicle without any structural connection between it and the user.

Another object of the present invention is to provide a toy vehicle of the type whose control means includes a control drive means rotatable in a 360° arc and whose operative position is determined by external commands received by a sensor so that a great number of operating states of the toy vehicle can be selected by the use of the proper command to thereby permit the user of the toy vehicle to have essentially complete control over its operation without any direct structural or manual connection therewith.

Another object of this invention is to provide a toy vehicle having the control means permitting the vehicle to be operated by voice or other commands to perform maneuvers not capable of being accomplished by toy vehicles of conventional design.

Other objects of this invention will become apparent as the following specification progresses, reference being had to the accompanying drawings for illustration of several embodiments of the invention.

IN THE DRAWINGS

Figure 1:
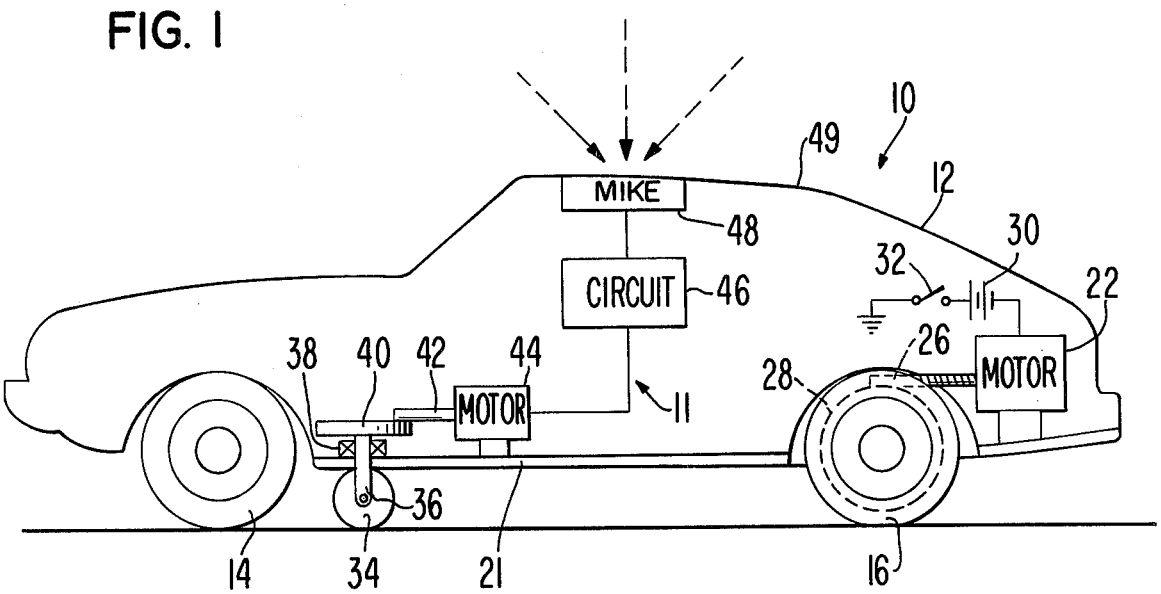
FIG. 1 is a side elevational view of one embodiment of the control means of the present invention when used with a toy vehicle withe wheels.

Toy vehicle 10 includes a control means 11, a base plate or support 21, a vehicle shell 12 of any suitable design, front wheels 14 and rear wheels 16. For purposes of illustrations, front wheels 14 do not engage or very lightly engage support surface 18 over which the vehicle moves. Rear wheels 16 engage surface 18 and are used to drive or move the vehicle forwardly. They are interconnected by a shaft 20 carried on support 21, shell 12 being coupled to base plate 21 in any suitable manner.

Shaft 20 is rotated in a counterclockwise direction (viewing FIG. 1) by a drive motor 22 carried within the shell on support 21. Motor 22 has a drive shaft 24 coupled in any suitable manner to shaft 20. For purposes of illustration, shaft 20 has a worm 26 thereon engaged with a worm gear 28 secured to shaft 20.

Motor 22 is energized by coupling the same to a suitable battery 30 in a circuit containing a manual switch 32. The switch can be located at any accessible position on vehicle shell 12. When the switch is closed, motor 22 is energized and rear wheels 16 are caused to rotate in a forward direction, propelling vehicle 10 forwardly.

Vehicle 10 further includes a directional control member in the form of a steering wheel 34 carried by a vertical shaft 36 rotatably mounted by a bearing 38 on support 21 centrally between the sides thereof. Bearing 38 allows shaft 36 and thereby wheel 34 to rotate freely throughout an arc of 360°.

For purposes of illustration, wheel 34 is ahead of rear wheels 16. It is possible to have front wheels 14 driven by a motor instead of rear wheels 16. In such a case, wheel 34 would be at a location rearwardly of its position shown in FIG. 1 for proper balance and steering. Thus, wheel 34 can either be forwardly or rearwardly of the wheels which drive or propel the vehicle.

Control means 11 includes a servo motor 44 used to rotate shaft 36 in one direction relative to support 21. Motor 44 is coupled to shaft 36 in any suitable manner. Typically, a gear-down sturecture is used because of the high speed rotation of the drive shafts of motors suitable for this purpose. This gear-down structure can be gears, i.e., a worm and worm gear, or, as shown in FIG. 1, can be a disc 40 coupled with shaft 36 and driven at its rim by the drive shaft of motor 44. For purposes of illustration, disc 40 is secured to the upper end of shaft 36 and disposed in a generally horizontal plane. Disc 40 is rotatable with shaft 36 and the drive shaft 42 of motor 44 is in frictional engagement with the upper surface of the disc adjacent to its outer periphery. Servo motor 44 is coupled with a circuit 46 having a microphone 48 coupled at its input.

Typically, disc 40 will rotate about 57 rpm and will have a diameter of about 2 inches. A typical motor is one made by Mabuchi Motor Co. Ltd., 314 Fifth Avenue, New York, N.Y. 10001 and identified as RE-360-24110 rated at 3.0 volts and operating at 4600 rpm. To use this motor with disc 40, it may be necessary to use an idler on drive shaft 42 for engaging the upper surface of disc 40 for further geardown purposes. Such idler is not shown in FIG. 1 but it is understood that the idler can be used if deemed necessary.

Microphone 48 is located in any suitable position on shell 12 and, for purposes of illustration, is located on its roof 49. The microphone senses spoken commands or sounds emanating from a location exteriorly of and spaced from shell 12. These sounds are indicated by arrows 50 (FIG. 1).

Figure 3:
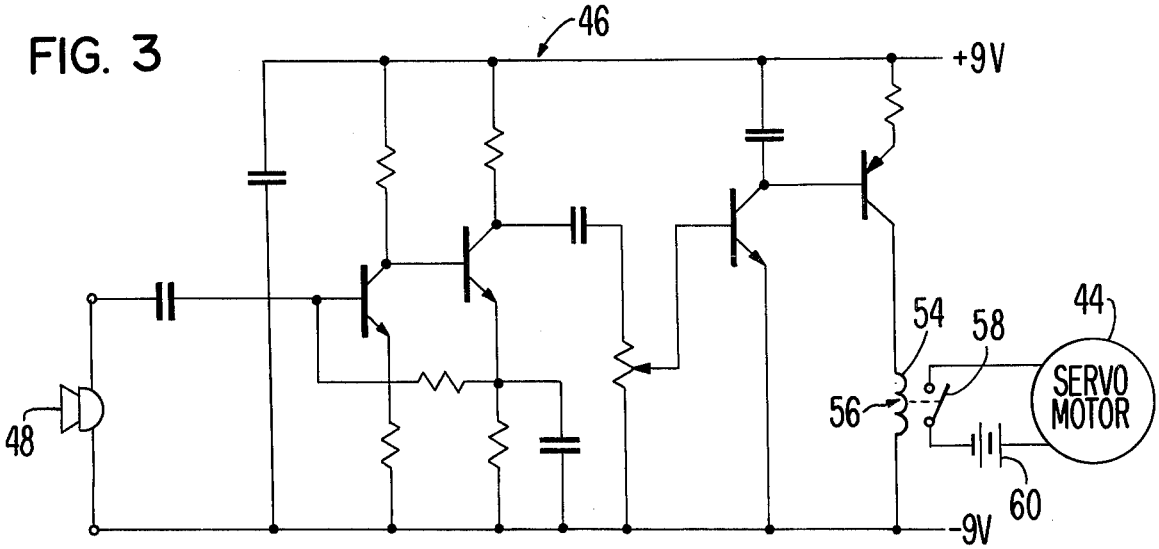
FIG. 3 is a wiring diagram showing the circuitry for actuating the servo motor of the control means of FIG. 1.

Circuit 46 is shown in more detail in FIG. 3 and includes a typical amplifier 52 for amplifing the voice signals or other sounds sensed by microphone 48. The amplified signals are used to energize the coil 54 of a relay 56 having a switch 58 coupled in a secondary circuit containing servo motor 44 and a battery 60.

In use, vehicle 10 is provided with batteries which serve as power sources for motor 22, motor 44 and circuit 46. Switch 32 is then manually actuated to operate motor 22 so that vehicle 10 is moved in a forwardly direction, assuming that wheel 34 is in position A as shown in dashed lines in FIG. 2. The vehicle will then continue in a forward direction until wheel 34 is rotated into another position.

If a voice command is given by the user to vehicle 10, the sound of the command is sensed by microphone 48 and converted thereby to an electronic signal which is amplified by circuit 46. The amplified signal will immediately energize coil 54 of relay 56 and switch 58 will close, thereby actuating motor 44. The command will, for purposes of illustration, be of a relatively short duration so that coil 54 will be energized only for the corresponding period of time.

As motor 44 is energized, disc 40 is caused to rotate in the direction of arrow 62 (FIG. 2), thereby rotating shaft 36 and wheel 34 through a certain arc, for instance, an arc of approximately 45°; thus, wheel 34 will move to position B. When this occurs, the vehicle will turn to the right and will continue to move to the right in a circle until the vehicle receives the next command.

If the next command is "stop", for instance, the sound of this command will be sensed, amplified and used for energizing servo motor 44. This will, for instance, cause wheel 34 to rotate into the third position shown in FIG. 2, namely position C, wherein the wheel axis is parallel to the normally forward movement of the vehicle. This will, in effect, stop the vehicle because the friction between wheel 34 and surface 18 will overcome the driving forces of rear wheels 16. The vehicle will remain in a stopped position even though rear wheels 16 will continue to rotate.

Figure 2:
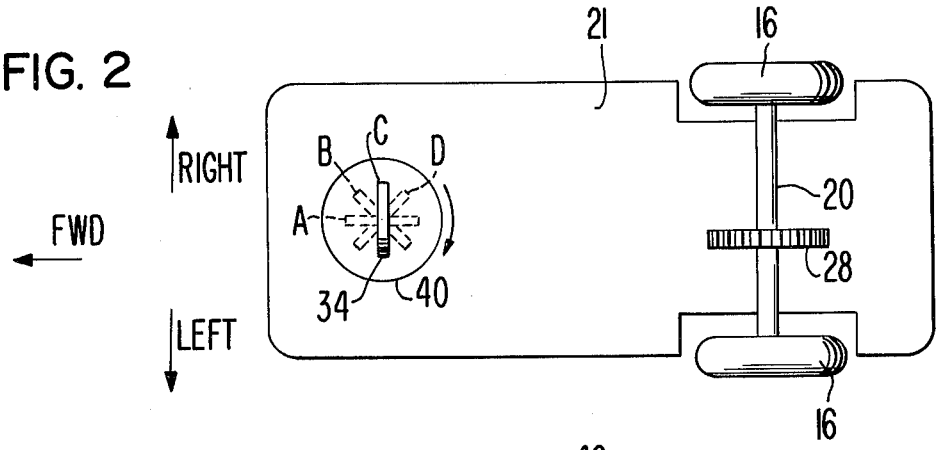
FIG. 2 is a plan view of the support of the toy vehicle of FIG. 1.

The next command can be of such duration that wheel 34 moves into any one of a plurality of other operative positions, even into positions intermediate the positions shown in FIG. 2. In fact, the wheel can move into a great number of positions within the 360° arc of rotation of disc 40 because the disc is controlled by drive shaft 42 of motor 44 and can be moved into a great number of rotative positions. However, in any case, motor 44 rotates disc 40 only in one direction, namely the direction of arrow 62.

Because disc 40 is rotatable throughout a 360° arc, the operation of vehicle 10 is random to the extent that any command can be given to the car and it will respond accordingly, assuming that the duration of the command is sufficient to change the operative position of wheel 34 from a first, earlier position to a second, desired position. The user must know the angular distance between the first and second positions so that he can make his command have the desired duration to effect the necessary rotation of shaft 36 and wheel 34 through appoximately the same angular distance. With a minimum of practice, this can be readily achieved.

For instance, if wheel 34 is in position C, vehicle 10 can be made to go forwardly by voicing a command of sufficient duration to cause motor 44 to keep disc 40 rotating through an arcuate distance of 90°. In such a case, the wheel will again assume the position A and, in so doing, will allow drive motor 22 to rotate wheels 16 and thereby move vehicle 10 in a forward direction.

Taking another illustration, assuming again that vehicle 10 is in a stopped position, i.e., wheel 34 is in the C position of FIG. 2, vehicle can be made to go left by voicing a command of sufficient duration to cause the wheel to move into position D. Then, the vehicle will continue to rotate in a circle to the left until the next command is given. Slight corrections can be made by commands of relatively short duration if, for instance, a shallower turn is desired.

If the next command following the command placing the wheel in position D is of sufficient duration, the wheel can move from position D again to positions A, B, or C or any intermediate position therebetween, all depending upon the duration of the voice command with reference to the position of wheel 34 when the command is given. Thus, it is clear that random operation of vehicle 10 is clearly achieved by 360° relative capability of drive shaft 42 of motor 44 user learning to voice his commands properly so that they cause vehicle 10 to perform exactly in accordance with the duration the voiced commands. This random aspect therefore provides much enjoyment and entertainment over long periods of time for children and adults alike and clearly operates to mystify persons who see the vehicle in operation for the first time.

Vehicle 10 need not be a wheeled vehicle, but can be a toy boat or toy submarine which floats on or below the surface of a body of water and is voice actuated as described above. The boat and submarine would both be moved forwardly by a propeller operated by a motor. In either case, the steering or directional member would be a rudder mounted on a vertical shaft and the control means would include a drive shaft or gear-down structure rotatable through a 360° arc and coupled to the rudder. Voice commands would cause the boat or submarine to go forward, to go left, to go right and to stop. In the stop position, the plane of the rudder would be transverse to the forward direction.

Figure 4:
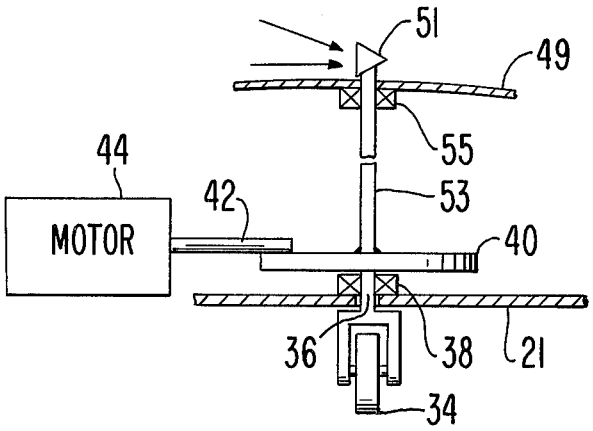
FIG. 4 is a elevational view, of another embodiment of the control means of the invention.
Figure 5:
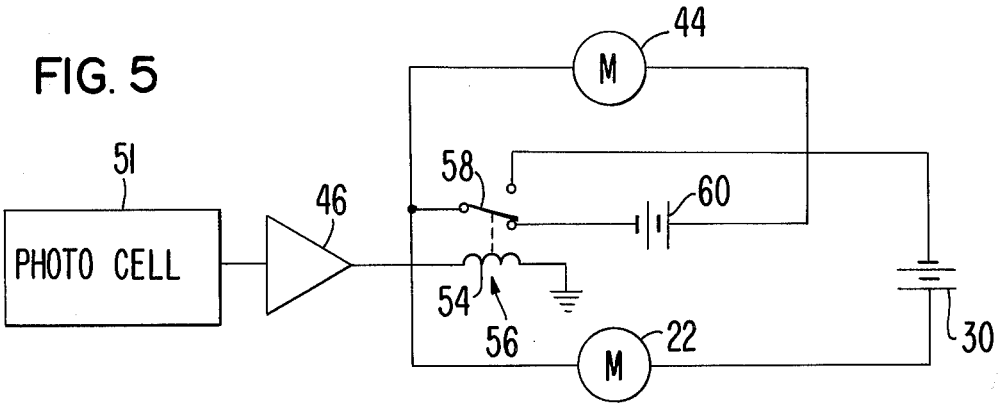
FIG. 5 is a wiring diagram showing the actuating circuitry for the embodiment of FIG. 4.

FIGS. 4 and 5 show another form of the signal input means to control means 11 wherein a photocell 51 sensitive to a light beam from an external source is connected directly to the upper end of a shaft 53 rigid to the center of disc 40 and extending upwardly therefrom. The upper end of the shaft 53 extends through roof 49 of shell 12 and is supported by a bearing 55 carried on the lower surface of the roof. As disc 40 rotates under the influence of servo motor 44, photocell 51 also rotates relative to the vehicle roof.

Photocell 51 and motor 44 are in a circuit shown in FIG. 5 wherein the output of photocell 51 is directed to circuit 46 for amplifying the signal therefrom. The output from the amplifier is directed to coil 54 of relay 56 having switch 58. Motor 44 is in one circuit containing battery 60 and switch 58 is normally closed so that motor 44 is normally operating. When this occurs, photocell 51 continually rotates to seek a light source. During this time, motor 22, which now forms part of the control means, is not actuated and vehicle 10 remains stationary.

When a light source is sensed, the signal generated by the photocell 51 energizes coil 54 of relay 56, causing switch 58 to move to a second position (FIG. 5) in which drive motor 22 is operated by means of battery 30. Thus, drive motor 22 drives the vehicle forwardly while motor 44 is de-energized. The vehicle will move in the direction in which wheel 34 is directed and if wheel 34 is not in position A (FIG. 2) when photocell 51 senses the light, vehicle 10 may require a series of stops and starts until wheel 34 is in position A of FIG. 2, in which case the vehicle will then continue to move substantially uninterruptedly toward the light source, assuming it is still operating.

Figure 6:
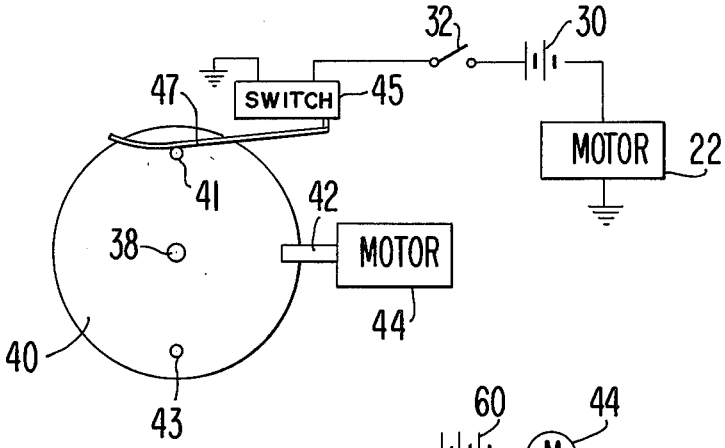
FIG. 6 is a top plan view of another embodiment of the control means.

Another improvement in the control means of toy vehicle 10 includes a limit means of the type shown in FIG. 6. Disc 40 is provided with two projection or pins 41 and 43 at diametrically opposite locations near the outer periphery of the disc. The projections can be cam surfaces, or magnetic parts if desired. A normally closed limit switch 45 having a switch arm 47 across the circular path of the pins and is movable to acuate the switch when arm 47 is engaged by either one of the pins. If magnetic parts are used, the switch is a reed switch.

Switch 45 is actuated when wheel 34 is in the C position of FIG. 2, which is the stopped position of vehicle 10. Switch 45 is coupled in series with switch 32 of motor 22 so that motor 22 is de-energized if switch 45 is actuated, i.e., opened. The switch is again closed to enable the circuit of motor 22 when a voice command or other sound is then received by microphone 48 for energizing motor 44 which again rotates disc 40, moving wheel 34 out of the stop position C shown in FIG. 6. Thus, when wheel 34 is stopped, motor 22 is de-actuated; otherwise, motor 22 is operating.

Figure 7:
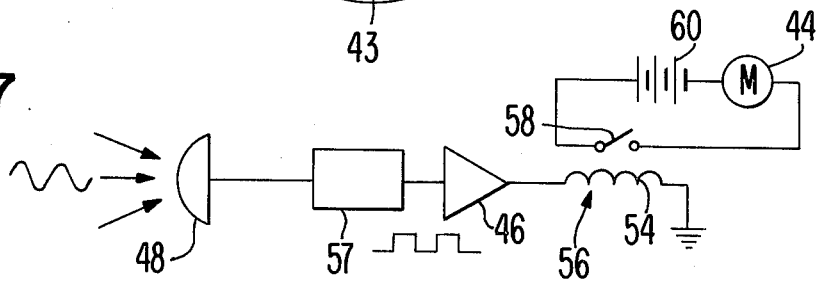
FIG. 7 is a schematic view of another embodiment of the control means.

Still another improvement of the control means of the toy vehicle is shown in FIG. 7 wherein microphone 48 is connected to a multivibrator 57 which emits a pulse signal of a predetermined width corresponding to a sound signal of a given duration. The output signal pulse of the multivibrator is amplified by circuit 46 before being applied to motor 44 through relay 56. The advantage of using the circuit in FIG. 7 is that each pulse of the multivibrator output will cause motor 44 to step through a predetermined arc, such as 45°. Thus, if a voice command is of sufficient duration to provide three pulses at the output of the multivibrator, the motor will step continuously through the three such predetermined arcs.

Figure 8:
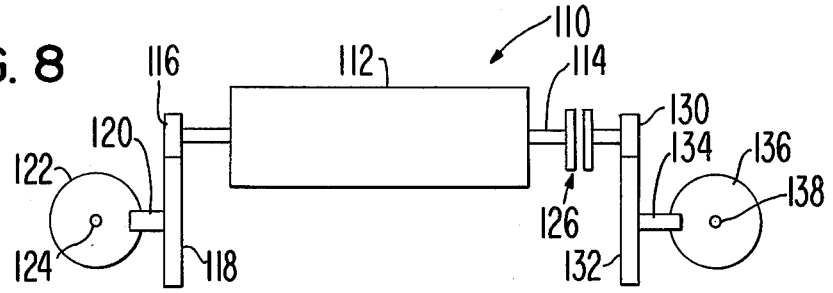
FIG. 8 is a top plan view of another embodiment of the control means using a single drive motor for operating a pair of spaced, driven devices.

A further embodiment of the control means of the toy vehicle is shown in FIG. 8 and is denoted by the numeral 110. Control means 110 includes a drive motor 112 having a drive shaft 114 which extends outwardly from opposed ends thereof. The motor is mounted in any suitable manner on a fixed support. One end of the drive shaft has a gear 116 thereon in mesh with a second gear 118 having a stub shaft 120 for rotating a disc or wheel 122 in a 360° arc about the axis of a shaft 124. Gears 116 and 118 can be replaced by a worm and worm gear for instance, for driving rear wheels 16 of vehicle 10. In the alternative, disc 122 can be secured to shaft 20 of vehicle 10 to drive it in the same way as it is driven by the worm and worm gear.

The opposite end of drive shaft 114 has a clutch 126 thereon so that shaft 114 can be selectively coupled to a stub shaft 128 having a gear 130 thereon, the gear being in mesh with the gear 132 having a stub shaft 134 thereon for engaging the flat side face of a disc 136 mounted for rotation on a shaft 138. Disc 136 would take the place of disc 40 in vehicle 10.

Figure 8A:
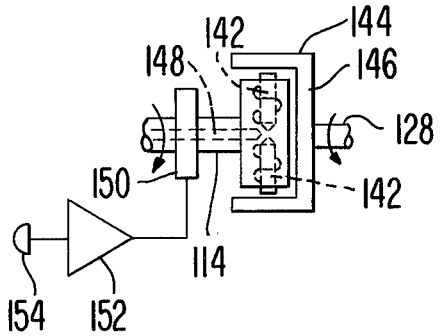
FIG. 8A is an enlarged, side elevational view of a clutch used with the embodiment of FIG. 8.

Clutch 126 can be of any suitable construction such as mechanical or magnetic. For purposes of illustration, it is of mechanical construction and has a structure as shown in FIG. 8A wherein shaft 114 has a member 140 divided with a pair of shiftable, spring biased, bolt-like elements 142 whose outer ends are adapted to frictionally engage the inner surface of an annular flange 144 on a disc 146 coupled to stub shaft 128. The end of rod 114 is hollow to receive a shiftable armature 148 of a solenoid having a coil 150 whose signal input is from the output of amplifier 152. A microphone 154 is coupled to the input of the amplifier. Thus, when a voice command is received by the microphone, the resulting signal is amplified and applied to coil 150, causing armature 148 to move toward and into engagement with elements 142, causing them to move radially outwardly and into frictional engagement with the inner surface of annular flange 144. Thus, shaft 114 is mechanically coupled to shaft 128 and disc 136 is then rotated. This occurs even while disc 122 continues to rotate.

Figure 9:
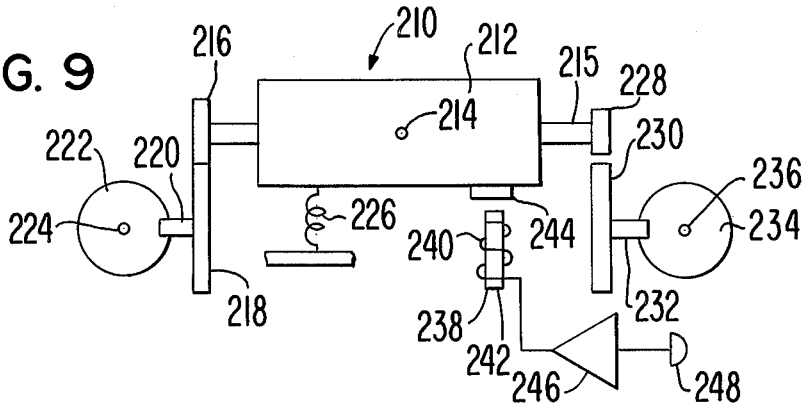
FIG. 9 is a top plan view of still another embodiment of a control means using a single motor.

Another embodiment of the control means utilizing a single motor to perform two functions is shown in FIG. 9 and is denoted by the numeral 210. It has a motor 212 pivotally mounted in any suitable manner for rotation about an axis through a central shaft 214 coupled to the motor. The drive shaft 215 of the motor has at one end thereof a spur gear 216 in mesh with a gear 218 having a stub shaft 220 in driving engagement with the side face of a disc 222 mounted for rotation in a 360° arc on a shaft 224. A coil spring 226 biases motor 212 in a counterclockwise sense when viewing FIG. 9. The opposite end of drive shaft 215 has a spur gear 228 thereon normally out of meshing relationship with a gear 230, the latter having a stub shaft 232 in frictional engagement with the side face of a disc 234 mounted for rotation in a 360° arc about a shaft 236.

A solenoid 238 having a coil 240 and an armature 242 is used to pivot motor 212 in a clockwise sense to move gear 228 into mesh with gear 230. To this end, a magnetic plate 244 on the side of the motor is attracted to armature 242 when the coil 240 is energized, such as from a signal from an amplifier 246 whos input is in a microphone or other sensor 248. Thus, when voice signals are received by the microphone, the resulting signals are amplified and applied to coil 240, energizing the coil and attracting plate 244 to armature 242, causing motor 212 to pivot in the clockwise sense against the biases forces 226. Gear 228 then meshes with gear 230, causing disc 234 to rotate about the axis of shaft 236 for the time during which plate 244 is attracted to armature 242. During this time, disc 222 is not rotated because gear 216 is out of mesh with gear 218.

When control means 210 is used with the toy vehicle of FIG. 1, disc 222 can be used to rotate the drive wheels thereof and disc 234 can be used for rotating the steering wheel thereof. When sounds are received, the drive wheels of the vehicle will not be rotated while the steering wheel is being rotated.

Figure 10:
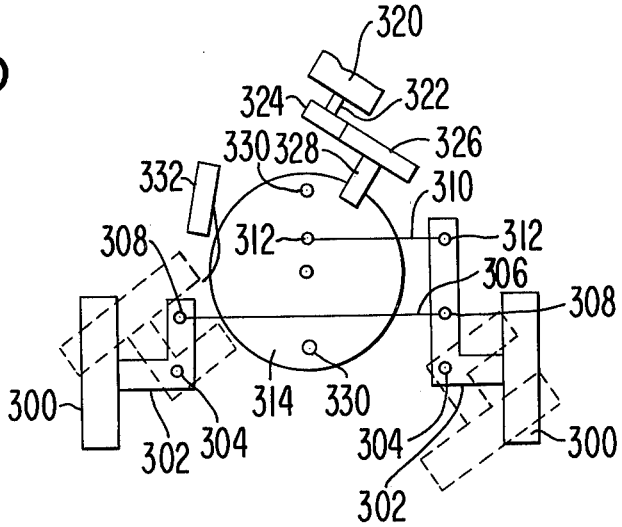
FIG. 10 is a top plan view of a further embodiment of a control means coupled with a pair of pivoted steering wheels of a toy vehicle.

FIG. 10 illustrates another type of steering mechanism for a toy vehicle and includes a pair of steered wheels 300 having L-shaped cranks 302 mounted for pivoting movement by respective vertical pins 304 coupled with a suitable support (not shown) such as support 21. This steering mechanism is used in lieu of steering wheel 34 on toy vehicle 10.

Cranks 302 are interconnected by a rod 306 pivotally mounted by pins 308 adjacent to the outer ends of the cranks. Another rod 310 is pivotally mounted by a pin 312 to the crank of one wheel and also pivotally mounted by a pin 312 to a disc 314 rotatable about a shaft 316 in the direction of arrow 318 by the operation of a motor 320 having a drive shaft 322 coupled with a gear 324 in mesh with a gear 326 having a stub shaft 328 in engagement with the side face of disc 314. The motor receives commands by way of a microphone in substantially the same way as that shown in FIG. 3.

Disc 314 has spaced pins 330 for actuating a switch 332 in the manner described above with respect to FIG. 6. Switch 332 is coupled with a wheel drive motor, such as motor 22 of toy vehicle 10 (FIG. 1) to shut off this motor when the wheels 300 approach positions transverse to the forward direction of travel of the vehicle.

Wheels 300 are caused to move to the right, to the left, to move straight forward or to move into positions intermediate the right, left and forward directions by voice commands received by the input means of motor 320. If it is desired to stop vehicle, the command is given to cause the wheels to move into the aforesaid transverse positions.

I claim:

1. A toy vehicle comprising: a support; means mounted on the support for permitting the latter to move along a medium; a steering member independent of said permitting means for engaging the medium along which the support is to be moved, said member having means mounted on the support for rotation about a generally vertical axis for movement through an arc of 360° and being rotatable into and out of any one of a plurality of operative positions relative to the support; a motor responsive to signals applied thereto and having a drive shaft rotatable in one direction; means coupling said drive shaft to said steering member for rotating the latter relative to said support as a function only of the duration of the signal applied to said motor, whereby the member will move from one operative position to another operative position with the two positions being separated by an arcuate distance corresponding in length to the period in which the motor is actuated; and means mounted in a fixed position on the support and responsive to an acoustic command emanating from a location remote from said support for providing a signal corresponding in duration to the duration of the acoustic command and for applying the signal to said motor.

2. A toy vehicle as set forth in claim 1, wherein said signal providing means comprises a microphone coupled to the support for receiving voice sounds.

3. A toy vehicle as set forth in claim 1, wherein said steering member has a shaft and a bearing for mounting on the shaft on said support for rotation through an arc of 360°.

4. A toy vehicle as set forth in claim 3, wherein said means coupling said drive shaft to said steering member includes a disk secured to said steering member shaft, said motor drive shaft being in frictional engagement with the disk near its outer periphery.

5. A toy vehicle as set forth in claim 4, wherein the disk has a pair of diametrically opposed projections mounted thereon near the outer periphery thereof and a switch mounted in a fixed position in the path of travel of said projections and being actuated when any one of the projections is in a predetermined operative location, the switch being coupled to said permitting means to control the operation thereof as a function of the location of the disk and thereby said steering member.

6. A toy vehicle as set forth in claim 1, wherein said means coupling said drive shaft to said steering member includes gear structure.

7. A toy vehicle as set forth in claim 1, wherein said steering member comprises a single wheel rotatable about a vertical axis through a 360° arc for engaging a surface below the support, said surface defining said medium.

8. A toy vehicle as set forth in claim 1, wherein said permitting means includes a second motor, and means responsive to the operative location of said steering member for controlling the operation of said second motor.

9. A toy vehicle as set forth in claim 8, wherein said coupling means has a movable projection thereon, said second motor having structure engageable with said projection and being connected to said motor to control the flow of electrical current thereto.

10. A toy vehicle as set forth in claim 1, wherein said generating and applying means includes a multivibrator.

11. A toy vehicle as set forth in claim 1, wherein said permitting means includes a pair of spaced wheels rotatably mounted on the support, and a second motor coupled with said wheels for rotating the same in one direction to propel the support over a surface engaged by the wheels.

12. A toy vehicle as set forth in claim 1, wherein said steering member includes a disk and a pair of spaced wheels, each of said wheels having a crank pivotally mounted on said support, a first rod pivotally interconnecting the cranks of said wheels, and a second crank pivotally connected to one crank and to said disk at a location radially spaced from the central axis thereof, said motor drive shaft being in functional engagement with the disk near the outer periphery thereof.

13. A toy vehicle as set forth in claim 12, wherein said permitting means includes a pair of spaced drive wheels, and a second motor coupled to said drive wheels for rotating the same, and a switch adjacent to said disk and responsive to an operative position thereof for controlling the operation of said second motor.

14. A toy vehicle comprising: a support; a pair of spaced drive wheels rotatably mounted on the support; means carried by the support for rotating the drive wheels in one direction to propel the support over a surface engaged by the drive wheels; a steering wheel; means mounting the steering wheel on the support at a location spaced from said drive wheels for rotation about a generally vertical axis through an arc of 360°, said steering wheel being engageable with said surface and operable to steer the support over the surface as the drive wheels propel the support; a motor coupled with said mounting means and actuated in response to a signal for rotating said steering wheel in one direction through an arc corresponding to the period of said signal; a microphone carried by the support and being operable to provide electronic signals responsive to sounds emanating from a plurality of directions relative to said support; and means coupling the microphone to said motor to direct signals thereto corresponding in duration to the duration of sounds received by the microphone, whereby the steering wheel rotating means is actuated and the steering wheel is rotated to another operative position relative to said support.

15. A toy vehicle as set forth in claim 14, wherein said mounting means includes a shaft, and a bearing rotatably mounting the shaft on said support, and including a disk carried by said shaft and rotatable therewith, said motor having a drive shaft in frictional engagement with said disk near its outer periphery.

16. A toy vehicle as set forth in claim 14, wherein said means for rotating said drive wheels includes a second motor, there being a switch carried by said support and being actuated as a function of the rotative position of said steering wheel, said switch being coupled to said second motor to de-actuate the latter when the steering wheel is in a predetermined operative position.

17. A toy vehicle as set forth in claim 16, wherein said means for mounting said steering wheel includes a shaft, there being a disk on said shaft, the disk having a pair of diametrically opposed projections thereon near its outer periphery, each projection being in a position on the disk corresponding to a stop position of said steering wheel, said switch having a shiftable arm extending across the path of the projections and engageable therewith to actuate the switch.

18. A toy vehicle comprising: a support; actuatable means mounted on the support for permitting the latter to move along a medium; a steering member for engaging the medium along which the support is to be moved, said member being mounted on the support for rotation about a generally vertical axis for movement between any one of a plurality of spaced, operative positions; a motor having a drive shaft rotatable in one direction, said drive shaft being normally coupled to said permitting means for actuating the same to cause said support to be moved along said medium; means responsive to a signal for coupling said drive shaft to said steering member to cause the latter to be rotated relative to said support, said member being movable under the influence of said motor into any of said operative positions as a function only of the duration of the signal; and means responsive to an acoustic command emanating from a location remote from said support for providing a signal corresponding in duration to the acoustic command and for applying the signal to said coupling means.

19. A toy vehicle as set forth in claim 18, wherein said coupling means includes a clutch.

20. A toy vehicle as set forth in claim 19, wherein said clutch has a pair of normally spaced, rotatable parts, and solenoid means responsive to a signal for releasably interconnecting said parts.

21. A toy vehicle as set forth in claim 18, wherein said motor is mounted on said support for movement from a first operative position to a second operative position and return, said drive shaft being coupled to said permitting means and out of coupled relationship with said steering member when the motor is in said first position, said drive shaft being out of coupled relationship with said permitting means and coupled with said steering member when said motor is in said second position, and means responsive to a signal for moving said motor from said first position to said second position, said motor being biased into said first position.

22. A toy vehicle as set forth in claim 21, wherein said moving means includes an electric coil having means for generating a magnetic field in response to said signal, said motor having a magnetically permeable part attracted to said coil when said field is generated.

* * * * *